US007121128B2

(12) United States Patent
Kato et al.

(10) Patent No.: US 7,121,128 B2
(45) Date of Patent: Oct. 17, 2006

(54) METHOD OF MANUFACTURING ELLIPTIC DEEP-DRAWN PRODUCTS

(75) Inventors: Hiroshi Kato, Wako (JP); Tomio Sugiyama, Wako (JP); Hirohide Azuma, Wako (JP); Tsugio Saito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 72 days.

(21) Appl. No.: 10/828,301

(22) Filed: Apr. 21, 2004

(65) Prior Publication Data

US 2004/0226333 A1 Nov. 18, 2004

(30) Foreign Application Priority Data

May 14, 2003 (JP) ..... 2003-136499

(51) Int. Cl.

| | |
|---|---|
| ***B21B 15/00*** | (2006.01) |
| ***B21D 22/00*** | (2006.01) |
| ***B64D 33/02*** | (2006.01) |
| ***F02B 27/00*** | (2006.01) |

(52) U.S. Cl. ..... 72/68; 72/83; 72/348; 72/379.6; 244/53 B; 137/17.1

(58) Field of Classification Search ..... 72/68, 72/82, 83, 347, 348, 379.6; 29/897, 897.32; 244/53 B; 137/15.1

See application file for complete search history.

(56) References Cited

U.S. PATENT DOCUMENTS

| | | | | |
|---|---|---|---|---|
| 438,406 | A * | 10/1890 | Dewey | 72/69 |
| 2,086,488 | A * | 7/1937 | Batie | 72/39 |
| 2,983,033 | A * | 5/1961 | Cox | 29/894.325 |
| 3,195,491 | A * | 7/1965 | Bulgrin et al. | 72/82 |
| 3,802,245 | A * | 4/1974 | Garner et al. | 72/344 |
| 4,129,025 | A * | 12/1978 | Carey et al. | 72/348 |
| 5,058,617 | A * | 10/1991 | Stockman et al. | 137/15.1 |
| 5,915,403 | A * | 6/1999 | McConachie et al. | 137/15.1 |
| 6,443,395 | B1 * | 9/2002 | Porte et al. | 244/134 R |
| 6,708,711 | B1 * | 3/2004 | Surply et al. | 137/15.1 |
| 6,837,459 | B1 * | 1/2005 | Gonidec et al. | 244/53 B |
| 6,866,223 | B1 * | 3/2005 | Chevalier | 244/53 B |

FOREIGN PATENT DOCUMENTS

JP 7-308724 A 11/1995

OTHER PUBLICATIONS

Ishikawa, Shinji. *High resolution sensing methods using optical fiber gratings.* Sumitomo Electric Industries, LTD. Yokohama Research Laboratories. Sakai-ku, Yokohama, 244-8588. pp. 648-654. (2000).

* cited by examiner

*Primary Examiner*—Ed Tolan
(74) *Attorney, Agent, or Firm*—Birch, Stewart, Kolasch and Birch, LLP

(57) ABSTRACT

A method of manufacturing an elliptic deep-drawn product including a first step of providing an intermediate product and a second step of providing an end product. In the first step, a rotary forming die is used to form in a blank a substantially round formed portion of a U-shaped cross-section. In the second step, the formed portion is deformed at its semicircular portion by press working to form an elliptic portion, being formed into a final shape.

15 Claims, 13 Drawing Sheets

METHOD OF MANUFACTURING ELLIPTIC DEEP-DRAWN PRODUCTS

This Nonprovisional application claims priority under 35 U.S.C. § 119(a) on Patent Application No(s). 2003-136499 filed in JAPAN on May 14, 2003, the entire contents of which are hereby incorporated by reference.

FIELD OF THE INVENTION

The present invention relates to a method of manufacturing elliptic deep-drawn products by deep-draw forming including a spinning process and a press working process.

BACKGROUND OF THE INVENTION

Deep-draw forming methods include spinning, press working and hydraulic forming.

In spinning, a blank is placed on a rotary forming die and then pressed against it using a spinning bar to a deep-drawn form.

In press working, a blank is pressed in a die (upper die, lower die) into a deep-drawn form. Under some conditions, the forming is divided into several steps.

There is another method of deep drawing through two processes of spinning and press working.

For example, manufacturing of cooking bowls in a D shape is performed through two processes of spinning and press working. Specifically, a blank is worked into a hemispherical shape by spinning, and then a part of the side surface of the hemispherical formed product is formed flat by press working to produce a D shape, which method is disclosed in Japanese Patent Laid-Open Publication No. HEI-7-308724. This D-shaped container manufacturing method will be described with reference to FIG. 15 hereof.

Referring to FIG. 15, in the conventional D-shaped container manufacturing method, first, a thin blank sheet is deep-draw formed by spinning to produce a hemispherical container 200. Then, the hemispherical container 200 is placed on a first die 211 of a press working device 210, and the side surface 201 of the hemispherical container 200 is partially pressed from the side as shown by arrow (a) into a flat shape using a second die 212, whereby to produce a D-shaped bowl form with the flatly crushed portion. Thus enabled is the production of a D-shaped container from a thin material.

Although the above manufacturing method enables deep-draw forming through spinning and subsequent press working, it is a manufacturing method only for D-shaped containers, and is not suitable for forming different shapes than bowl shapes. Different products require different numbers of drawing steps and different dies, resulting in different process steps suitable for the respective different products. If it is possible to previously spin form a shape which prevents fracture and wrinkling in final press working, the effects of spinning such as reduction in die cost can be obtained.

It is thus desired to be able to form an elliptic deep-drawn product of a U-shaped cross section in two processes of a spinning process and a press working process, so as to reduce production costs even in small-quantity production.

SUMMARY OF THE INVENTION

According to the present invention, there is provided a method of manufacturing an elliptic deep-drawn product, which comprises: a first series of steps of providing an intermediate product, the steps including placing a blank on a spinning forming die, pressing the blank onto the forming die with a spinning bar, and forming a substantially round formed portion of a U-shaped cross-section; and a second series of steps of providing an end product, the steps including placing the intermediate product in a press working die, and causing deformation with the die in a semicircle of the formed portion to form an elliptic portion and also causing deformation in another semicircle of the formed portion to form the formed portion into a final shape.

In the first series of steps of the invention, the rotary forming die is used to form the substantially round formed portion of the U-shaped cross section.

In the second series of steps, the press working die causes deformation in the semicircle of the formed portion to form the elliptic portion while forming the formed portion into a final shape, thus causing no fracture and wrinkling in the formed portion of the final shape.

That is, the substantially round formed portion of the U-shaped cross section required for final press working is preformed by spinning, which eliminates the need for providing a press working process before the second series of steps. The elimination of a press working process results in reduction of die cost of the press working die. Thus, even a small-quantity production of deep-drawn products having an elliptic shape can be reduced in cost.

The end product is preferably a nacelle lip of an airplane engine. Nacelle lips of airplane engines can be produced by performing press working after spinning, resulting in reduced costs of production of the nacelle lips even in low volumes.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
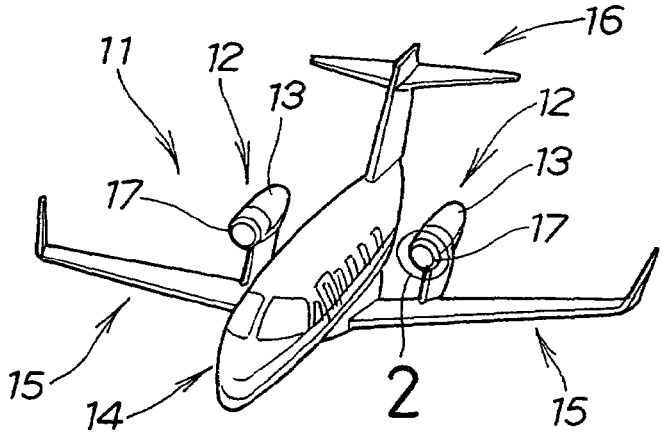
FIG. 1 is a schematic diagram of an airplane with an elliptic deep-drawn product manufactured by a manufacturing method according to the present invention.

An elliptic deep-drawn product formed by a manufacturing method of this invention is used on an airplane 11, for example, as shown in FIG. 1.

The airplane 11 has a body 14, two main wings 15, 15 and a tail assembly 16 attached to the body 14.

An elliptic deep-drawn product 17 is used as a nacelle lip provided at the front end of a nacelle 13 of an engine 12 on the airplane 11, covering the front end of the nacelle 13, permitting introduction of air into the engine 12.

Figure 2:
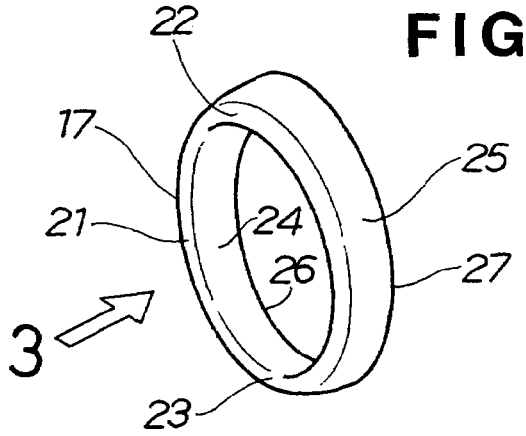
FIG. 2 is an enlarged perspective view of the elliptic deep-drawn product at a portion indicated at 2 in FIG. 1.

FIG. 2 illustrates the nacelle lip (elliptic deep-drawn product) 17 shown in FIG. 1. The nacelle lip 17 includes a lip top 21, an upper lip portion 22, a lower lip portion 23, an inner peripheral portion 24 contiguous to the lip top 21, an outer peripheral portion 25, an inner edge 26 of the inner peripheral portion 24, and an outer edge 27 of the outer peripheral portion 25. The upper lip portion 22 has a shape of a part of an ellipse.

Figure 3:
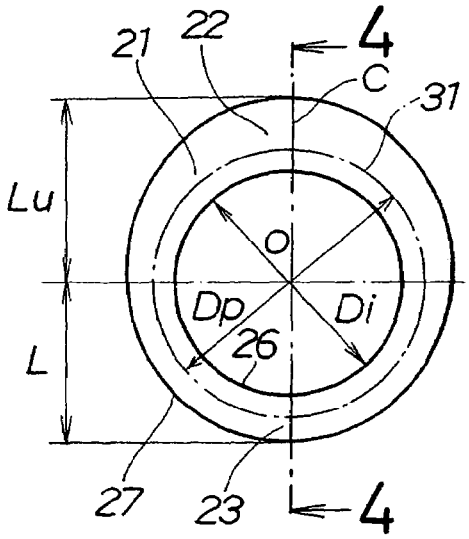
FIG. 3 is a front view of the elliptic deep-drawn product shown in FIG. 2 when viewed in the direction of arrow 3.

FIG. 3 illustrates that the upper lip portion 22 is elliptic with respect to the lower lip portion 23. Reference sign 31 denotes the centerline of the lip top 21, O the center of the lip top 21, Dp the diameter of the lip top 21, Di the diameter of the inner edge 26, and C a line of symmetry. L denotes the distance between the center O and the outer edge 27 at the lower lip portion 23. Lu denotes the distance between the center O and the outer edge 27 at the upper lip portion 22. The distances L and Lu are in the relation of Lu>L.

Figure 4:
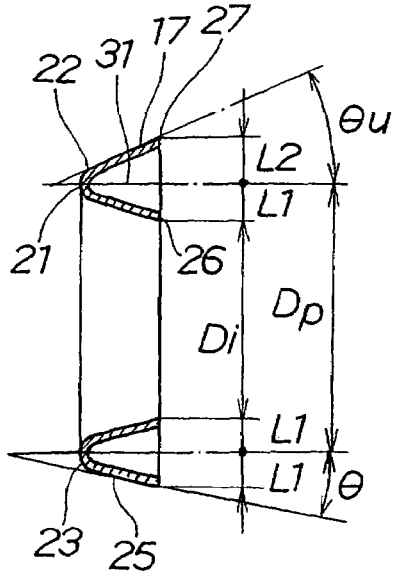
FIG. 4 is a cross-sectional view taken along line 4—4 of FIG. 3.

FIG. 4 illustrates that the distance between the centerline 31 and the inner edge 26 is L1, the distance between the centerline 31 and the outer edge 27 at the lower lip portion 23 is also L1, the distance between the center line 31 and the outer edge 27 at the elliptically-formed upper lip portion 22 is L2, and the distance L2 is set larger than the distance L1.

The angle of the outer peripheral portion at the lower lip portion 23 is set at θ, and the angle of the outer peripheral portion 25 at the upper lip portion 22 is set at θu. The angles θ and θu are in the relation of θu>θ.

A method of manufacturing the nacelle lip (elliptic deep-drawn product) 17 in which the shape of the upper lip portion 22 is different from the shape of the lower lip portion 23 as described above will be described with reference to the process chart of FIG. 5.

Figure 5:
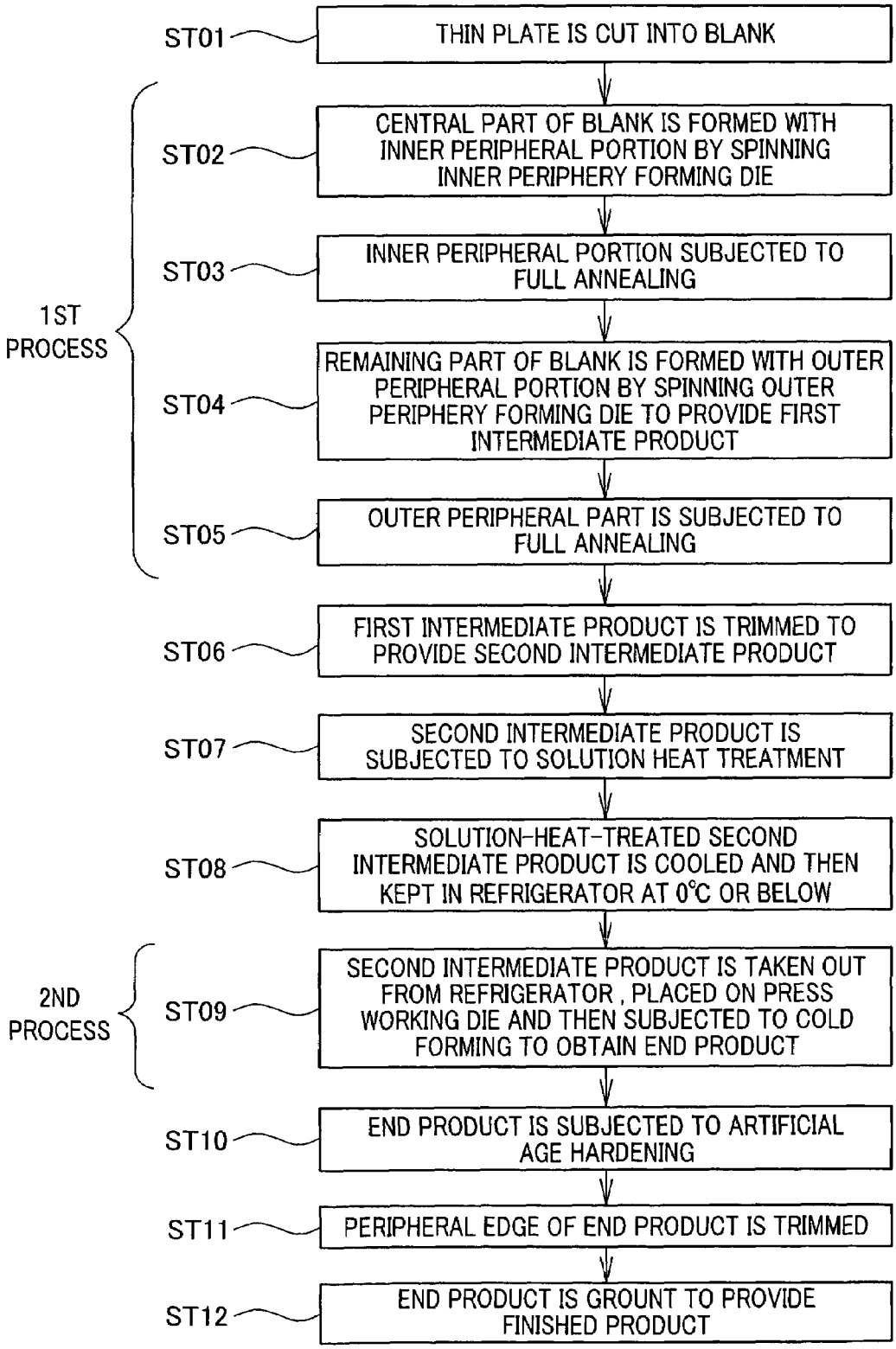
FIG. 5 is a process chart illustrating the manufacturing method of the elliptic deep-drawn product in the invention.

As shown in FIG. 5, the elliptic deep-drawn product manufacturing method has a first process and a second process as main processes. The first process is a spinning process including steps of step (hereinafter abbreviated as "ST") 02 to ST05 in which a blank is prepared. The second process is a press working process including a step of ST09 for final shape forming.

ST01: A thin plate is cut to obtain a blank 34 shown in FIG. 6A.

Figure 6A:
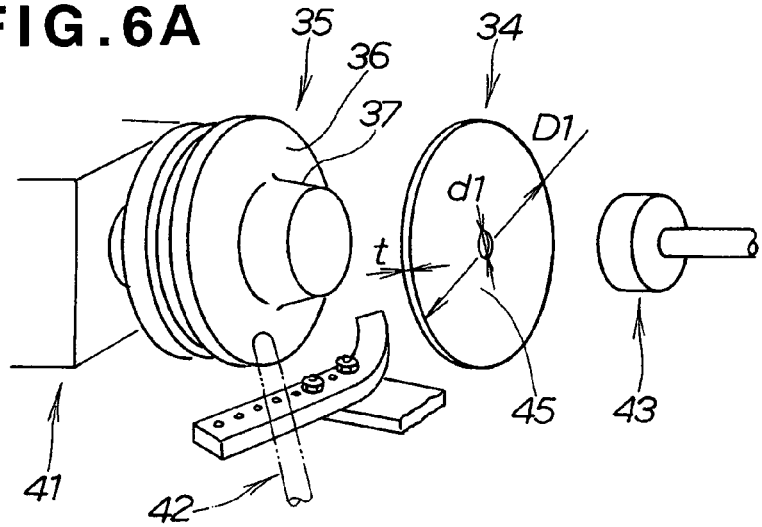
FIGS. 6A to 6E are diagrams illustrating a concrete example of steps ST02 and ST03 shown in FIG. 5.

ST02: The blank 34 shown in FIG. 6A is formed at its central portion 45 with an inner peripheral portion 24 (see FIG. 2) by a spinning inner periphery forming die 35.

ST03: The inner peripheral portion 24 is subjected to full annealing.

Figure 7A:
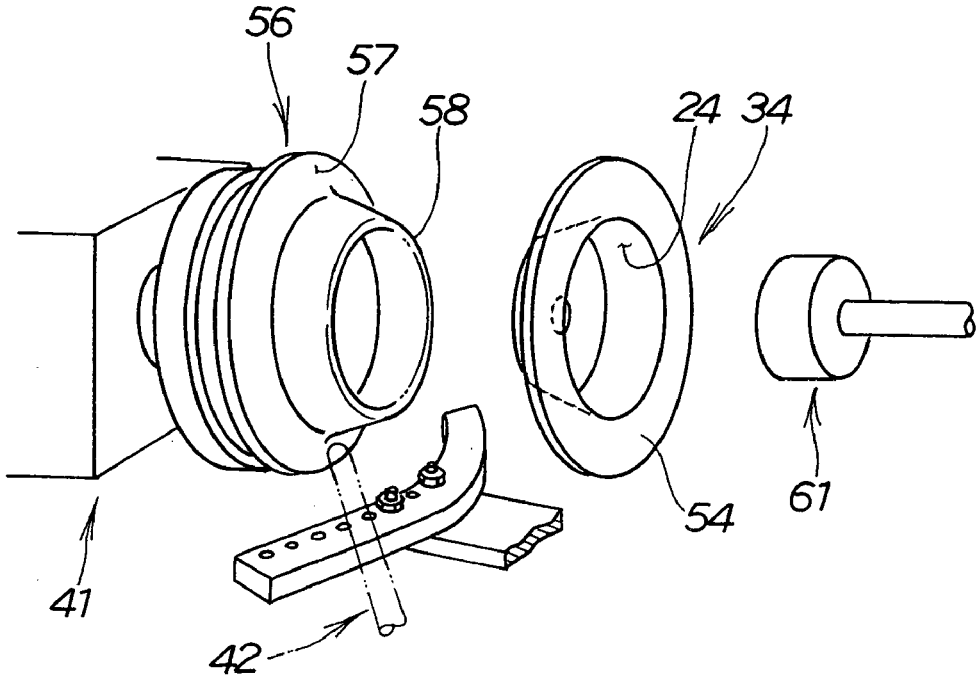
FIGS. 7A to 7C are diagrams illustrating a concrete example of step ST04 shown in FIG. 5.
Figure 7B:
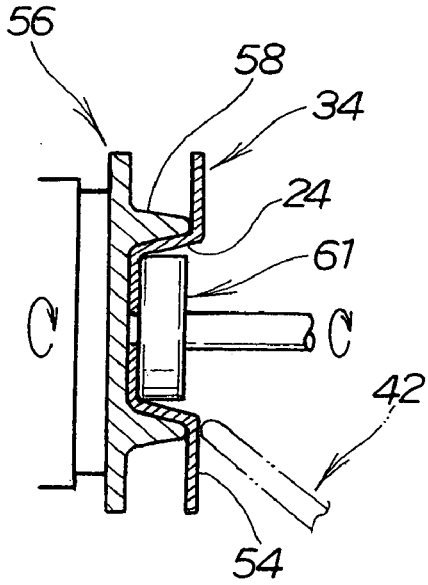
Figure 7C:
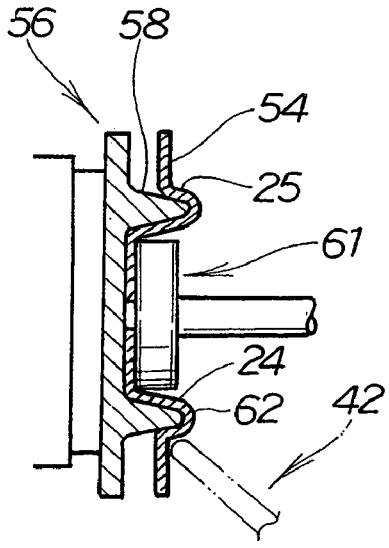

ST04: As shown in FIGS. 7A to 7C, the blank 34 is formed at the remaining portion 54 with an outer peripheral portion 24 by a spinning outer periphery forming die 56 to obtain a first intermediate product 66 having a substantially round formed portion 65 as shown in FIGS. 8D and 8E.

ST05: The outer peripheral portion 25 is subjected to full annealing.

ST06: The first intermediate product 66 is subjected to trimming to obtain a second intermediate product 74 shown in FIGS. 9A and 9B.

Figure 10A:
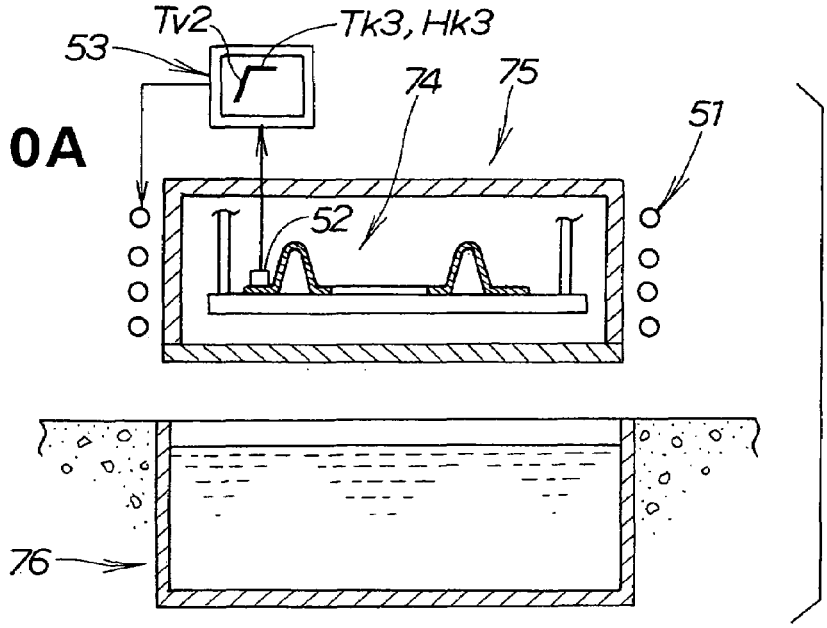
FIGS. 10A to 10C are diagrams illustrating solution heat treatment of the intermediate product in ST07 and ST08 shown in FIG. 5.
Figure 10B:
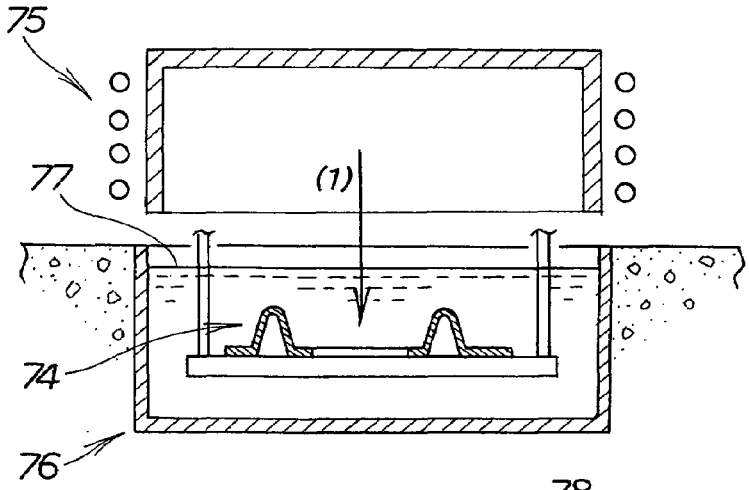

ST07: As shown in FIGS. 10A and 10B, the second intermediate product 74 is subjected to solution heat treatment.

Figure 10C:
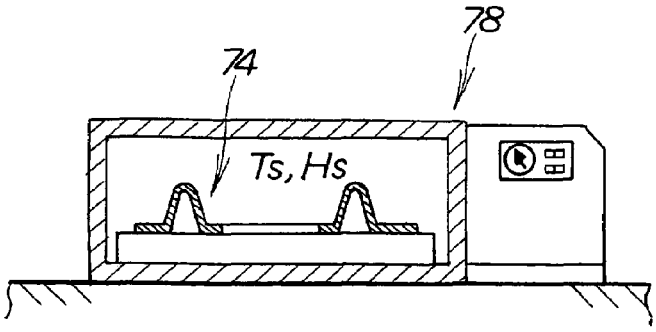

ST08: The solution-heat-treated second intermediate product 74 is cooled, and then, as shown in FIG. 10C, the temperature of the second intermediate product 74 is maintained at 0° C. or below in a refrigerator 78.

Figure 11A:
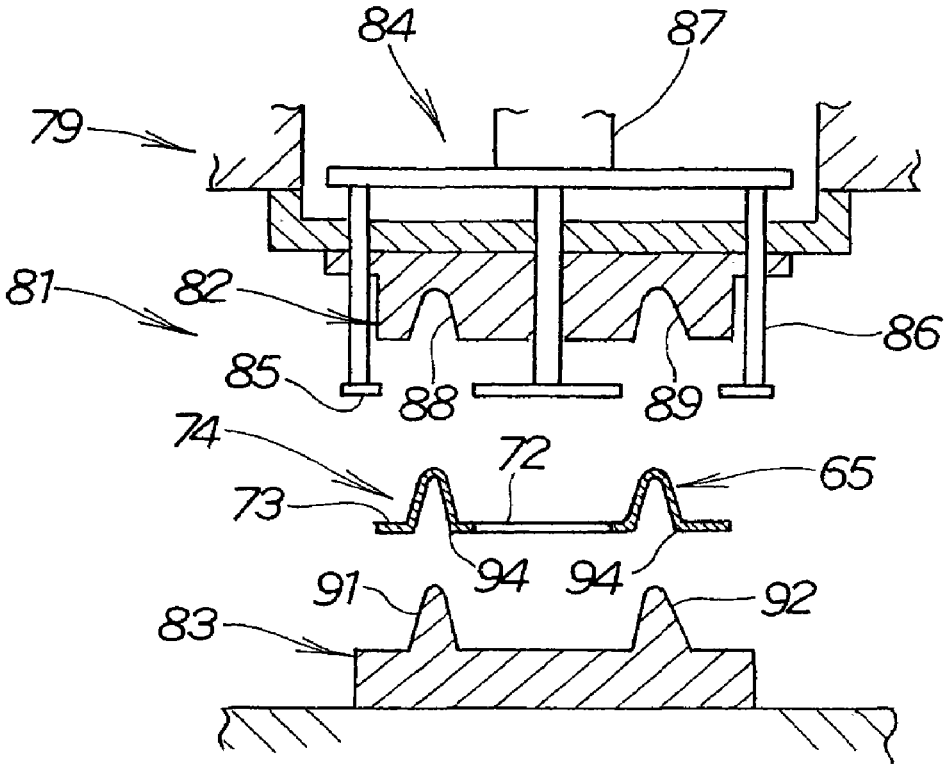
FIGS. 11A to 11F are diagrams illustrating a concrete example of step ST09 shown in FIG. 5.
Figure 11B:
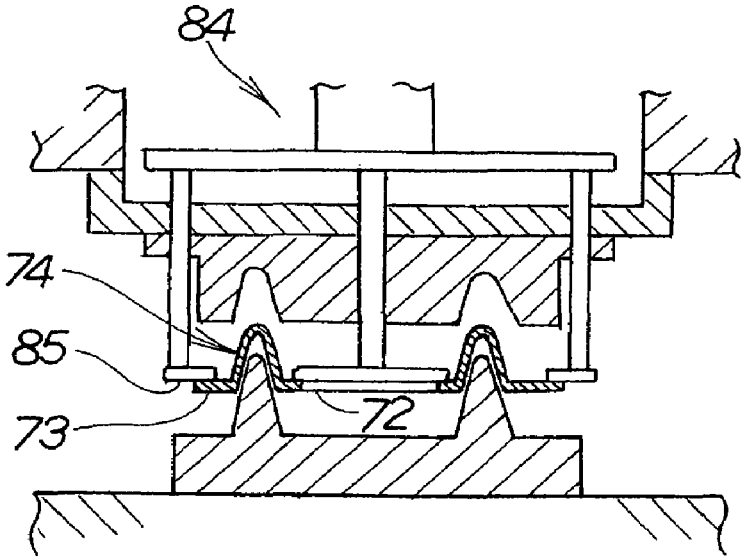

ST09: For press working, the second intermediate product 74 is removed from the refrigerator 78 shown in FIG. 10C, placed in a press working die 81 as shown in FIGS. 11A and 11B, and subjected to cold forming to obtain a formed portion 96 formed in a final shape including an elliptic portion 95 (see FIGS. 11E and 11F), and simultaneously to obtain an end product 97.

Figure 12:
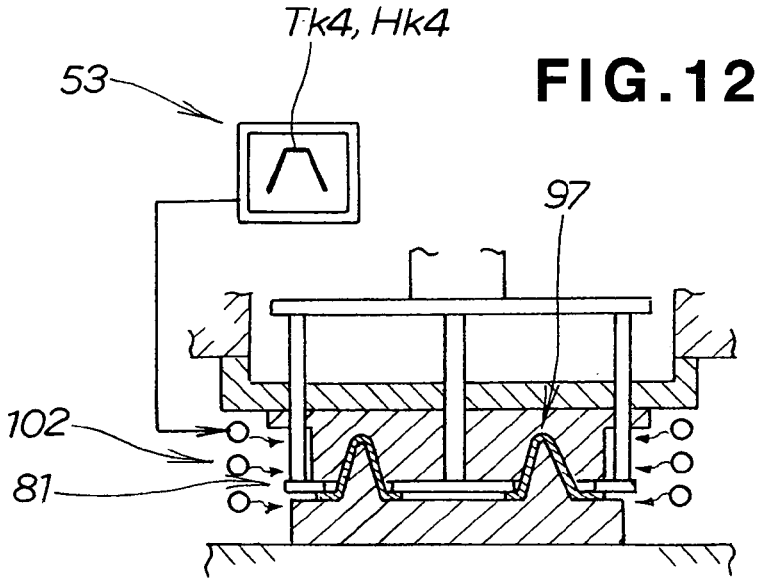
FIG. 12 is a diagram illustrating artificial age hardening of an end product in ST10 shown in FIG. 5.

ST10: As shown in FIG. 12, the end product 97 is subjected to artificial age hardening.

Figure 13A:
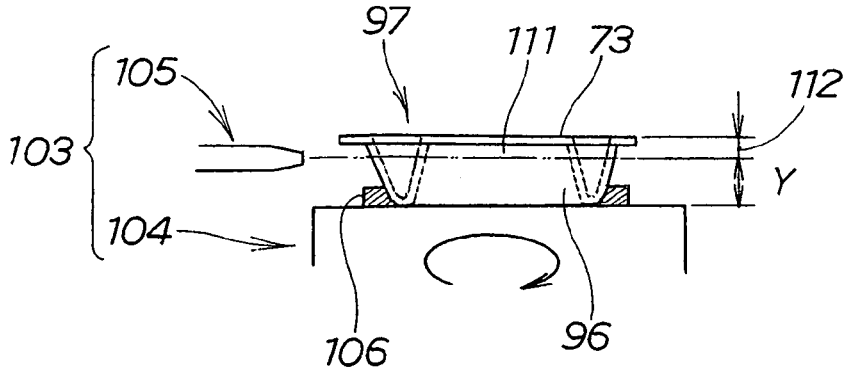
FIGS. 13A and 13B are diagrams illustrating a concrete example of trimming and grinding steps of the end product in ST11 and ST12 shown in FIG. 5.

ST11: As shown in FIG. 13A, a peripheral edge 111 of the end product 97 is trimmed.

Figure 13B:
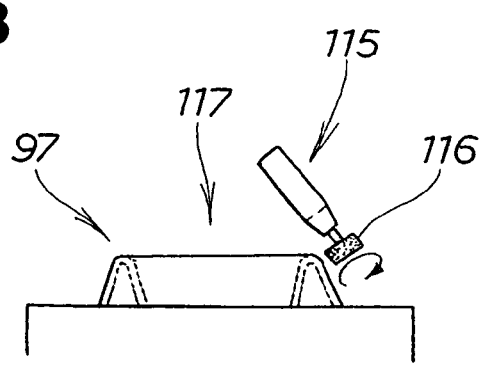

ST12: As shown in FIG. 13B, the end product 97 is ground to obtain a finished product 117.

Now, ST01 to ST12 shown in FIG. 5 will be described in detail with reference to FIGS. 6A to 13B.

FIGS. 6A to 6E illustrate a concrete example of steps ST02 and ST03 in the first process shown in FIG. 5;

As shown in FIG. 6A, the blank 34 is placed on the inner periphery forming die 35. The inner periphery forming die 35 is a spinning forming die. Specifically, the blank 34 has the dimensions of inside diameter d1, outside diameter D1 (e.g., 80 mm), and thickness t (e.g., 2 mm). The material of the blank 34 is an aluminum alloy. For example, JIS-A6061-O, an Al—Mg—Si system alloy, is used.

The inner periphery forming die 35 includes a flat portion 36 and a protruded portion 37 of a central protruded portion of the flat portion 36. The flat portion 36 is mounted to a spinning lathe 41. Reference numeral 42 denotes a spinning bar, and 43 a first blank holder.

Figure 6B:
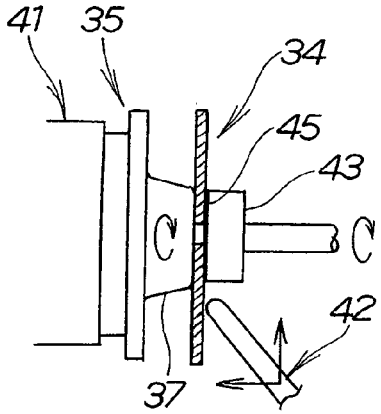

As shown in FIG. 6B, the blank 34 is pressed against the inner periphery forming die 35 with the first blank holder 43 to be placed thereon, and then the spinning lathe 41 rotates the inner periphery forming die 35 to rotate the blank 34. The central portion 45 of the blank 34 is pressed onto the inner periphery forming die 35 with the spinning bar 42.

Figure 6C:
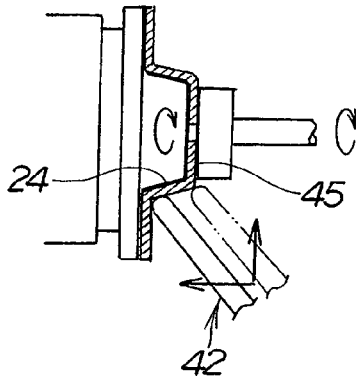

In FIG. 6C, the central portion 45 is cold-worked by the pressure of the spinning bar 42 to form the inner peripheral portion 24 to a predetermined draw height.

Figure 6D:
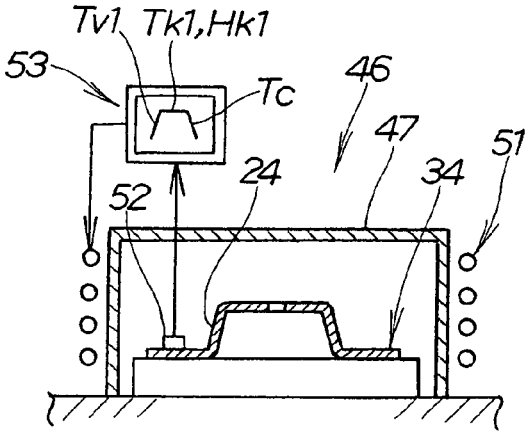

In FIG. 6D, the inner peripheral portion 24 is subjected to full annealing (JIS-W-1103) in a heat treat furnace 46. The heat treat furnace 46 has a furnace body 47, a heating means 51, and a controller 53 for controlling the heating means 51 based on preset temperature conditions and information from a thermocouple 52. The full annealing temperature conditions are made based on JIS-W-1103.

Here, full annealing is determined by temperature rising rate Tv1, holding temperature Tk1, and holding time Hk1 for the blank 34. For example, the holding temperature Tk1 is 413° C., the holding time Hk1 is one hour, cooling rate Tc is 26° C./1 h until 260° C., and after 260° C., furnace cooling is done.

Figure 6E:
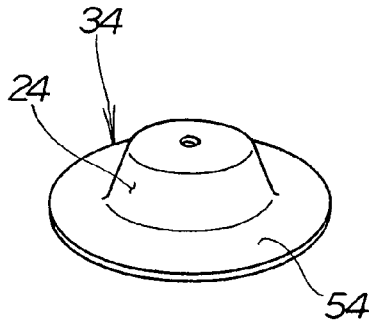

FIG. 6E is a perspective view of the blank 34 with the spin-formed inner peripheral portion 24, illustrating the formation of the inner peripheral portion 24. The remaining portion 54 of the blank 34 is subsequently subjected to spinning.

FIGS. 7A to 7C illustrate ST04 in the first process shown in FIG. 5.

As shown in FIG. 7A, the blank 34 formed with the inner peripheral portion 24 is placed on the outer periphery forming die 56 as a spinning forming die. The outer periphery forming die 56 includes a flat portion 57, a ring-shaped protruded portion 58 contiguous to the flat portion 57, and a second blank holder 61. The flat portion 57 is mounted to the spinning lathe 41.

The outside diameter of the second blank holder 61 is smaller than the inside diameter of the inner peripheral portion 24 so as to press the center of the blank 34.

In FIG. 7B, the inner peripheral portion 34 of the blank 34 is fitted into the ring-shaped protruded portion 58. A central portion of the blank 34 is pressed by the second blank holder 61 to be placed onto the ring-shaped protruded portion 58, and then the outer periphery forming die 56 is rotated to rotate the blank 34. The remaining portion 54 of the blank 34 is pressed onto the outer periphery forming die 56 by the spinning bar 42.

In FIG. 7C, the remaining portion 54 is pressed onto the ring-shaped protruded portion 58 with the spinning bar 42 for cold working to partially form the outer peripheral portion 25.

Since the central portion of the blank 34 is held by the second blank holder 61 in the process of spin working the outer peripheral portion 25, a top portion 62 can be smoothly plastically formed contiguously with the inner peripheral portion 24, and also the outer peripheral portion 25 can be smoothly plastically formed contiguously with the top portion 62.

FIGS. 8A to 8E illustrate a concrete example of ST04 and ST05 in the first process shown in FIG. 5.

Figure 8A:
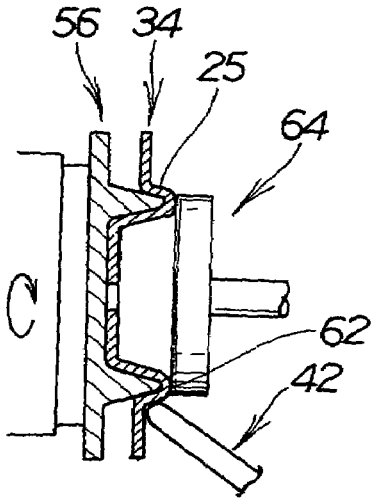
FIGS. 8A to 8E are diagrams illustrating a concrete example of steps ST04 and ST05 shown in FIG. 5.

In FIG. 8A, for spin working the outer peripheral portion 25, the second blank holder 61 (see FIG. 7A) is replaced with a third blank holder 64, and the spin working of the outer peripheral portion 25 is continued. The third blank holder 64 has a larger diameter than that of the top portion 62 for holding the top portion 62.

Figure 8B:
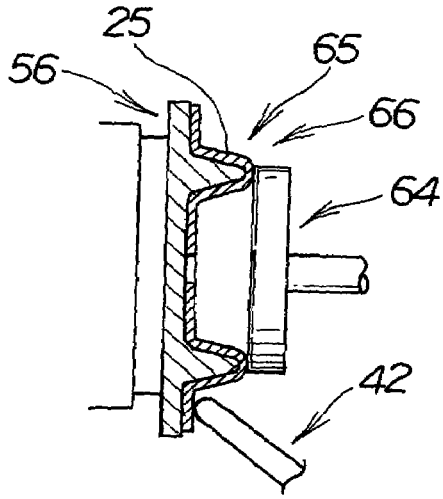

In FIG. 8B, the formation of the outer peripheral portion 25 results in the formation of the substantially round formed portion 65 of a U-shaped cross section to a predetermined draw height, and also results in the first intermediate product 66 as an intermediate product.

Figure 8C:
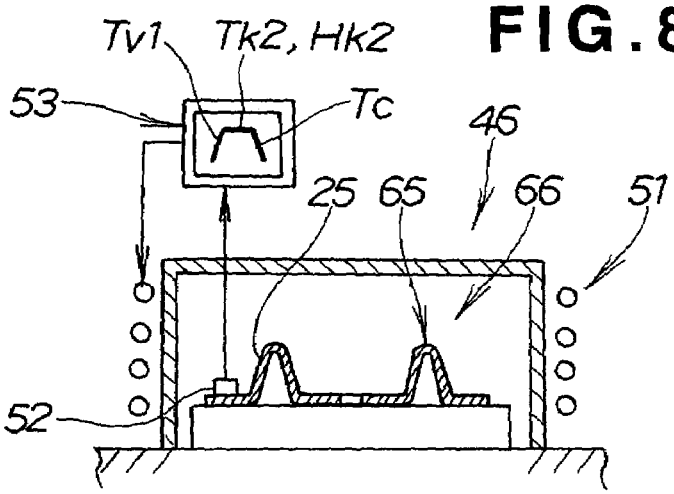
Figure 8D:
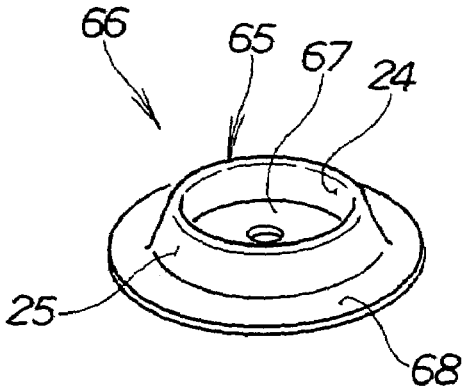
Figure 8E:
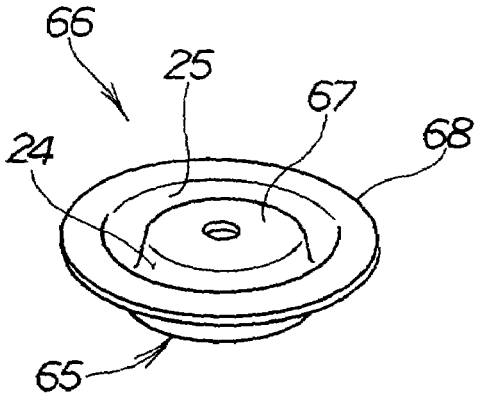

In FIG. 8C, the outer peripheral portion 25 is subjected to full annealing in the heat treat furnace 46. Temperature conditions in full annealing are made based on JIS-W-1103.

Here, the temperature conditions in full annealing are the same as in the full annealing of the inner peripheral portion 24 described with FIG. 6D, and include holding temperature Tk2 (Tk2=Tk1) and holding time Hk2 (Hk2=Hk1).

FIGS. 8D and 8E are perspective views of the first intermediate product 66, illustrating the formation of the substantially round formed portion 65 to the predetermined draw height. Reference numeral 67 denotes an inner redundant member and 68 an outer redundant member.

As shown in FIGS. 6A to 8E, in the first process shown in FIG. 5, the blank 34 is placed on a spinning forming die (inner periphery forming die 35, outer periphery forming die 56), and the blank 34 is pressed against the forming die by the spinning bar 42 to form the substantially round formed portion 65 of the U-shaped cross-section, whereby to obtain the first intermediate product 66. The number of dies for forming the first intermediate product 66 is only two, the inner periphery forming die 35 and the outer periphery forming die 56, resulting in a reduced die cost as compared with a press working die (upper and lower dies). Further, even in small-quantity production, the production cost of the elliptic deep-drawn product 17 (see FIG. 1) can be reduced.

Now, the trimming of the first intermediate product 66 shown in ST06 of FIG. 5 will be described with reference to FIGS. 9A and 9B.

Figure 9A:
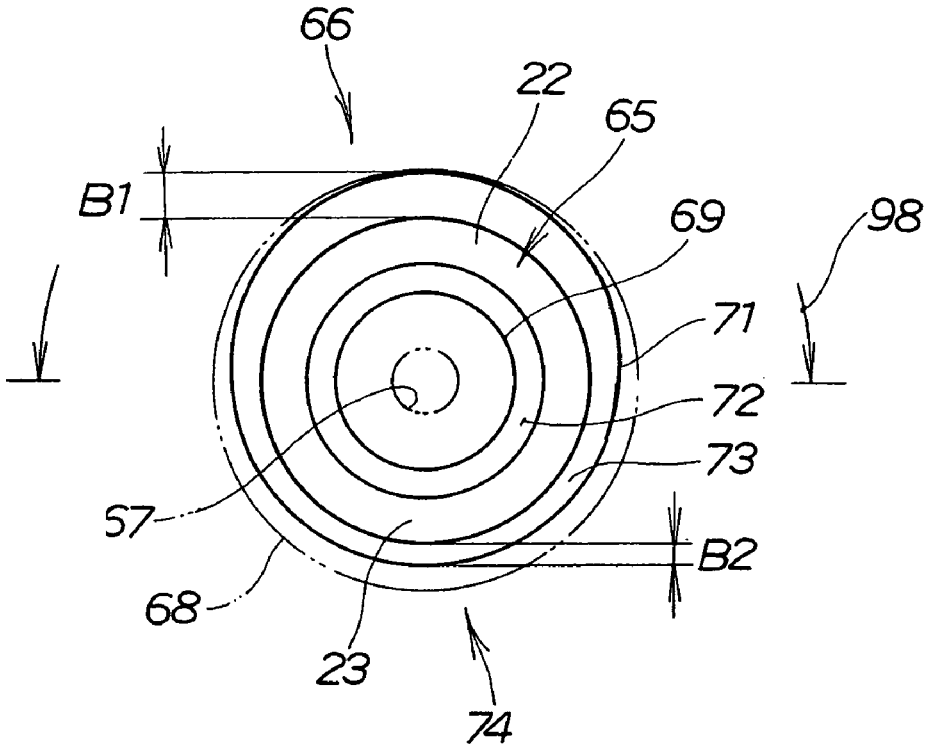
FIGS. 9A and 9B are diagrams illustrating trimming of an intermediate product in ST06 shown in FIG. 5.

As shown in FIG. 9A, the inner and outer redundant members 67, 68 of the first intermediate product 66 are trimmed. Specifically, the inner redundant member 67 is cut at the location of an inner trim line 69, and the outer redundant member 68 is cut at the location of an outer trim line 71. The trimming provides the second intermediate product 74 with an inner flange 72 and an outer flange 73 formed inward and outward contiguously with the formed portion 65.

The outer flange 73 is provided with an area of distance B1 from the formed portion 65 at the upper lip portion 22, and is provided with an area of distance B2 (B2<B1) from the formed portion 65 at the lower lip portion 23. That is, the outer flange 73 is cut along the outer trim line 71 into an elliptic shape in a plan view.

Figure 9B:
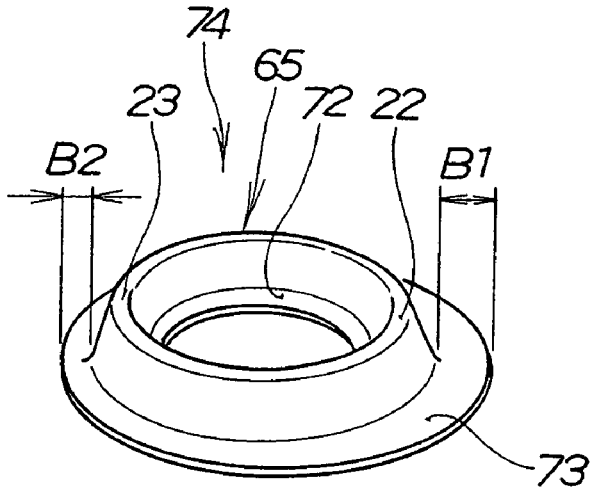

FIG. 9B is a perspective view of the trimmed second intermediate product 74. For trimming, any device can be used.

The provision of the outer flange 73 of distance B1 at the upper lip portion in the above trimming step allows for the prevention of thickness reduction in the following second process of press working by causing the inflow of the outer flange 73 of distance B1.

Now, the solution heat treatment of the second intermediate product 74 shown in ST07 and ST08 of FIG. 5 will be described with reference to FIGS. 10A to 10C.

As shown in FIG. 10A, the second intermediate product 74 is subjected to solution heat treatment. Temperature conditions in solution heat treatment are made based on JIS-W-1103.

Temperature conditions in solution heat treatment include temperature rising rate Tv2, holding temperature (solution heat treatment temperature) Tk3, and holding time Hk3. For example, the solution heat treatment temperature Tk3 is set at 529° C., and the holding time Hk3 is set at half an hour.

A heat treatment furnace 75 used here is substantially identical with the heat treatment furnace 46 (see FIG. 6D) and description thereon will not be made.

Then, as shown in FIG. 10B, the second intermediate product 74 is cooled.

For example, the second intermediate product 74 is put into water 77 in a water tank 76 as shown by arrow (1) to be quenched. Time it takes to put it out of the heat treatment furnace 75 into the water 77 should not over ten seconds. Equipment such as the heat treatment furnace 75 and the water tank 76 is exemplary. Water may be kept at a constant temperature. Alternatively, coolant other than water such as oil may be used.

As shown in FIG. 10C, the second intermediate product 74 is then placed in the refrigerator 78 to make the temperature of the second intermediate product 74 to Ts and to maintain the temperature Ts for holding time Hs.

The holding time Hs is a waiting time or a travel time until the start of the second process.

Here, the temperature Ts is set at −42° C. and the holding time Hs is set at five minutes.

Thus keeping the temperature of the second intermediate product 74 at Ts in the refrigerator 78 prevents aging of the second intermediate product 74 and hardening of the aluminum alloy.

Now, the second process of ST09 shown in FIG. 5 will be described in detail with reference to FIGS. 11A to 11F.

First, as shown in FIG. 11A, the second intermediate product 74 held in the refrigerator 78 (see FIG. 10C) is removed from the refrigerator 78, and, before the start of its hardening at room temperature, the second intermediate product 74 is placed in the press working die 81 mounted to a press 79. The die 81 consists of an upper die 82 and a lower die 83.

A cushion device 84 including a blank holder 85, a cushion pin 86 and an actuating means 87 is disposed at the press 79. The actuating means 87 includes a hydraulic cylinder, for example.

The upper die 82 has a circular depression 88 located left in FIG. 11A and an elliptic depression 89 located right, being contiguous to the circular depression 88 and gradually increased in diameter.

The lower die 83 has a circular protrusion 91 located left in FIG. 11A and an elliptic protrusion 92 located right, being contiguous to the circular protrusion 91 and gradually increased in diameter.

The second intermediate product 74 removed from the refrigerator 78 is placed on the lower die 83. Specifically, the substantially round formed portion 65 is placed on the circular protrusion 91 and the elliptic protrusion 92 of a continuous ring shape of the lower die 83 as shown in FIG. 11B. Edges 94, 94 of the inner and outer flanges 72, 73 line contact the circular protrusion 91 and the elliptic protrusion 92.

Then, the cushion device 84 is lowered by the press 79.

As shown in FIG. 11B, the blank holder 85 of the cushion device 84 presses the inner flange 72 and the outer flange 73.

Figure 11C:
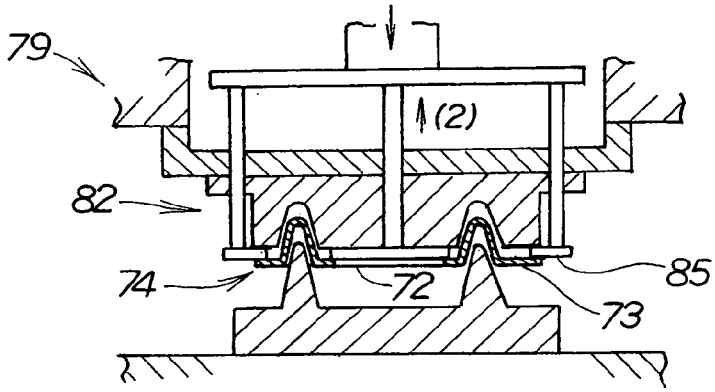

As shown in FIG. 11C, the press 79 is further lowered to apply pressure on the second intermediate product 74 with the upper die 82. At that time, the blank holder 85 retreats as shown by arrow (2) while maintaining the pressure on the inner and outer flanges 72, 73.

Figure 11D:
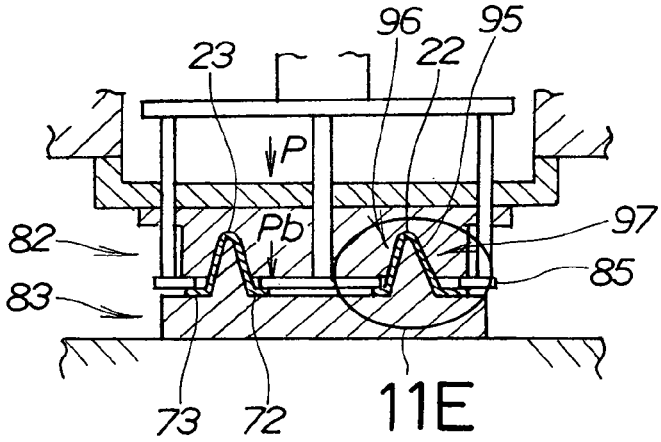

As shown in FIG. 11D, the upper die 82 is lowered to the downward limit, causing plastic deformation in the second intermediate product 74 between the upper die 82 and the lower die 83 (see FIG. 11C), thereby forming the formed portion 96 in the final shape including the elliptic portion 95 and simultaneously providing the end product 97. At that time, the blank holder 85 pressurizes the inner and outer flanges 72, 73 at a predetermined flange holding pressure Pb ($Kg/cm^2$).

Figure 11E:
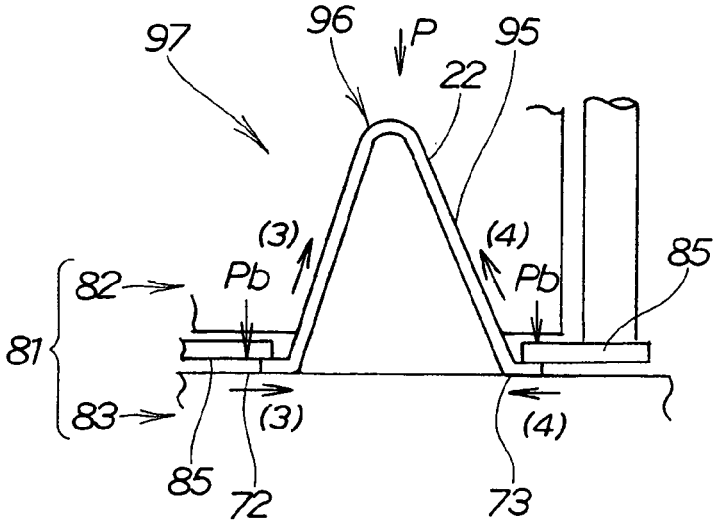

FIG. 11E is an enlarged view of a portion 11E in FIG. 11D, illustrating the formation of the formed portion 96 in the final shape by causing deformation in the substantially round formed portion 65 of the second intermediate product 74 (see FIG. 9B) with the press working die 81.

In the second process, the inner and outer flanges 72, 73 formed inward and outward of the formed portion 65 of the second intermediate product 74 shown in FIG. 9B are pressurized by the blank holder 85 at the predetermined flange holding pressure Pb. Therefore, when the formed portion 65 is pressurized in the die 81, the inner and outer flanges 72, 73 slidingly flow in as shown by arrows (3), (4), preventing reduction in the thickness of the formed portion 96 in the final shape, preventing fracture of the formed portion 96, and preventing flange wrinkling.

Figure 11F:
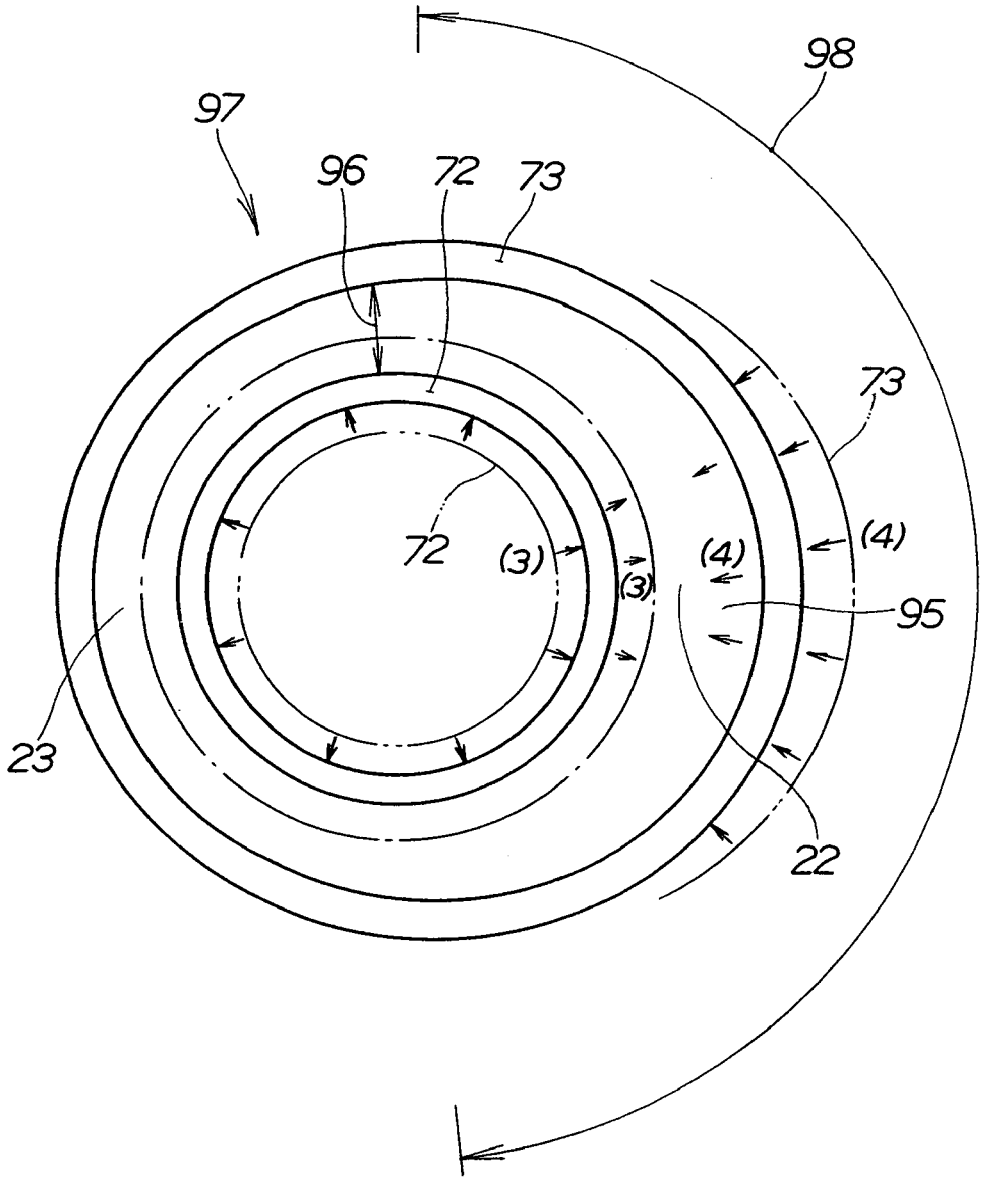

FIG. 11F illustrates the formed portion 96 of the end product 97 and the inner and outer flanges 72, 73 left inward and outward contiguously with the formed portion 96, shown in solid lines, and also illustrates the formation of the elliptic portion 95 by causing deformation in a semicircle 98 of the formed portion 65 formed by spinning (see FIG. 9B).

The outer flange 73 is formed in the step of trimming as shown in chain double-dashed lines, so that, when draw forming the elliptic portion 95 in the second process, the outer flange 73 is caused to slidingly flow in as shown by arrows (4) to prevent the reduction of thickness of the elliptic portion 95.

The inner flange 72 is formed as shown in chain double-dashed lines, so that, when draw forming the formed portion 65 in the second process, the inner flange 72 is caused to slidingly flow in as shown by arrows (3) to prevent the reduction of thickness of the formed portion 96.

As described above, in the second process illustrated in FIGS. 11A to 11F, the second intermediate product 74 is placed in the press working die 81 which causes deformation in the semicircle 98 of the formed portion 65 (see FIG. 6) to form the elliptic portion 95 and also forms the formed portion 96 in the final shape from the formed portion 65 shown in FIG. 9B, whereby to obtain the end product 97. Thus, the two processes of the spinning process performed in the first process and the press working process performed in the second process enables the formation of the elliptic deep-drawn product 17 having the formed portion 95 of the U-shaped cross section.

Now, the process of artificial age hardening of an end product in ST10 shown in FIG. 5 will be described with reference to FIG. 12.

The end product 97 is subjected to the artificial age hardening while held in the die 81. The artificial age hardening is performed based on JIS-W-1103.

Here, the heating means 102 and the controller 53 for controlling the heating means 102 based on preset temperature conditions are used. The process conditions are holding temperature Tk4 and holding time Hk4. The holding temperature Tk4 is set at 177° C., and the holding time Hk4 is set at ten hours, for example.

Thus, after the second process, the artificial age hardening is performed, thereby to further increase the strength of the aluminum alloy of a heat treatment alloy used for the end product 97.

Now, the trimming step and the grinding step in ST11 and ST12 shown in FIG. 5 will be described with reference to FIGS. 13A and 13B.

As shown in FIG. 13A, the end product 97 is trimmed by a cutting device 103. The cutting device 103 has a turntable 104 and a laser cutter 105. The end product 97 is placed on a positioning means 106 of the turntable 104. With the turntable 104 rotated, the laser cutter 105 cuts the peripheral edge 111 to height Y (e.g., 120 mm) to provide the formed portion 96 of the height Y. A cut-off portion 112 is discarded.

Then, an affected portion at the peripheral edge 111 is removed, and the peripheral edge 111 is worked into a groove (groove provided in a member to weld) shape to be circumferentially weldable.

The peripheral edge 111 is cut by the laser cutter 105, but may be cut by other device than the laser cutter 105, alternatively.

As shown in FIG. 13B, next, the end product 97 is ground by a grindstone 116 of a grinding means 115 to obtain the finished product 117. That is, the elliptic deep-drawn product 17 (see FIG. 1) is obtained. The end product 97 is preferably mirror finished with the surface roughness of Rmax=0.5S or less, for example. To achieve Rmax=0.5S or less, lapping or polishing may be chosen instead, or the processes may be done in order (grinding$\Delta$lapping).

Figure 14:
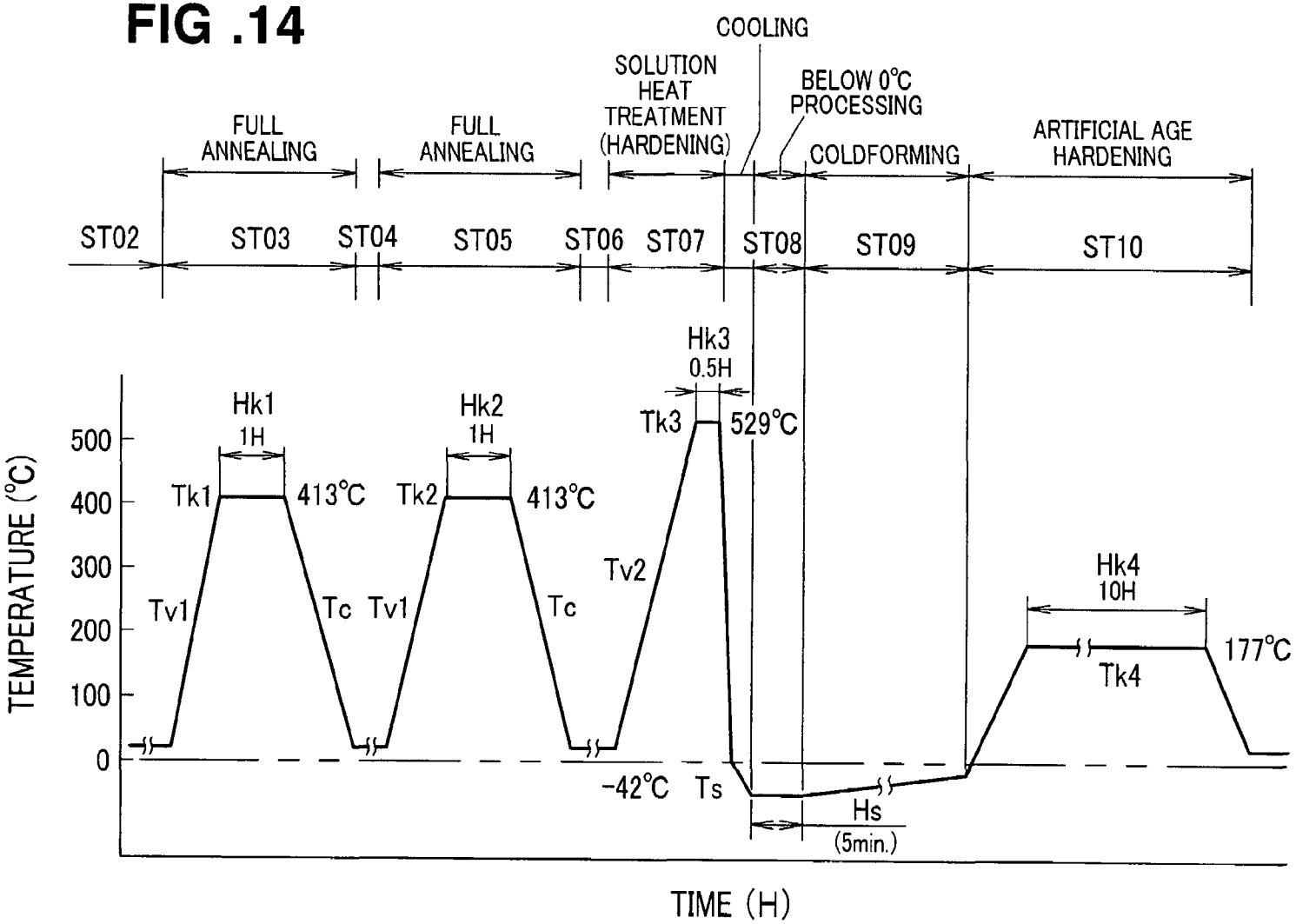
FIG. 14 is a temperature diagram illustrating temperature transition in the manufacturing method of this invention.
Figure 15:
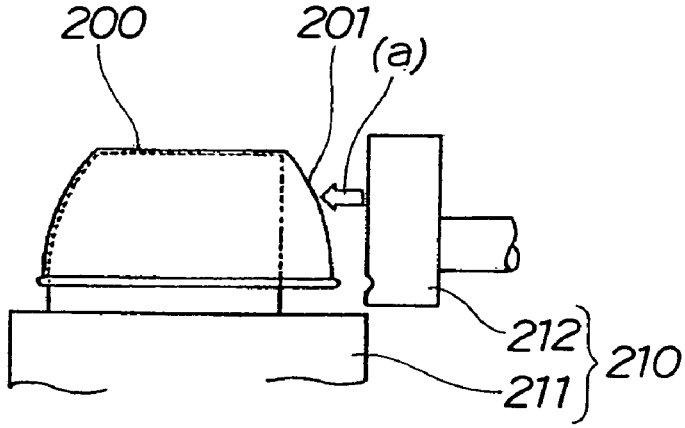
FIG.15 (PRIOR ART)
FIG. 15 is a diagram illustrating a conventional method of manufacturing a thin metal sheet D-shaped container.

FIG. 14 is a temperature diagram illustrating the transition of temperature effected in the elliptic deep-drawn product manufacturing method according to the present invention. The horizontal axis shows time (H) and the vertical axis shows temperature (° C.).

After the first process of spinning (cold working), full annealing, solution heat treatment, cooling, and holding in the refrigerator are performed, and in the second process of press working, cold forming is performed, and thereafter, artificial age hardening is performed.

The full annealing temperature conditions are such that the holding temperatures Tk1 and Tk2 are 413° C., respectively, and the holding times Hk1, Hk2 are one hour, respectively.

The solution heat treatment temperature conditions are such that the holding temperature (solution heat treatment temperature) Tk3 is 529° C., and the holding time Hk3 is half an hour.

The full annealing and solution heat treatment after cold working can relieve stress after the cold working and improve formability.

After cooling, the product is held in the refrigerator, in which the temperature Ts is set at −42° C. and the holding time Hs is set at five minutes.

The artificial age hardening temperature conditions are such that the holding temperature Tk4 is 177° C. and the holding time Hk4 is ten hours.

The artificial age hardening can further increase the strength of the heat treatment alloy aluminum alloy used for the elliptic ring body 17.

Between the first process and the second process shown in the embodiment of this invention, a new process may be added. For example, after the trimming step after the first process, a perforation step may be provided.

In this embodiment, the elliptic deep-drawn product 17 is exemplarily described as an airplane nacelle lip. The present invention, however, is not limited to this embodiment and is applicable to dome-shaped products such as airplane tail cones and train (bullet train) noses.

Obviously, various minor changes and modifications of the present invention are possible in the light of the above teaching. It is therefore to be understood that within the scope of the appended claims the invention may be practiced otherwise than as specifically described.

What is claimed is:

1. A method of manufacturing an elliptic deep-drawn product, comprising:

a first series of steps of providing an intermediate product, the steps including placing a blank on a spinning forming die, pressing the blank onto the forming die with a spinning bar, and forming a substantially round formed portion of a U-shaped cross-section; and a second series of steps of providing an end product, the steps including placing the intermediate product in a press working die, and causing deformation with the press working die in a semicircle of the substantially round formed portion to form an elliptic portion, and also causing deformation in another semicircle of the substantially round formed portion to form the substantially round formed portion into a final shape.

2. The method according to claim 1, wherein the end product is a nacelle lip of an airplane engine, the nacelle lip having an upper lip portion and a lower lip portion, the upper lip portion having a shape of a part of an ellipse, and the lower lip portion having a shape of a part of a circle.

3. The method according to claim 1, further comprising the step of trimming inner and outer redundant members of the intermediate product prior to performing the second series of steps.

4. The method according to claim 3, wherein the step of trimming provides an outer flange with an edge having a maximum distance B1 from the substantially round formed portion at an upper lip portion, and an edge having a maximum distance B2 (B2<B1) from the substantially round formed portion at a lower lip portion.

5. The method according to claim 3, wherein the step of trimming provides an outer flange with an edge having a maximum distance B1 from the substantially round formed portion at an upper lip portion, the outer flange being cut into an elliptical shape when viewed in a plan view.

6. The method according to claim 1, wherein the step of causing deformation with the press working die in a semicircle of the substantially round formed portion to form an elliptic portion is performed by placing the substantially round formed portion on a circular portion and an elliptic protrusion of a continuous ring of the press working die.

7. The method according to claim 1, wherein the final shape includes the elliptic portion.

8. The method according to claim 1, wherein the step of causing deformation in another semicircle of the substantially round formed portion to form the substantially round formed portion into a final shape, includes the step of applying pressure to the substantially round formed portion, thereby causing an inner and outer flange of the substantially round formed portion to slidingly flow in a direction toward the elliptic portion.

9. The method according to claim 8, wherein the step of applying pressure prevents a reduction of thickness of the elliptic portion in the final shape.

10. The method according to claim 1, wherein the semicircle and the another semicircle have a common center point.

11. A nacelle lip of an airplane engine, comprising:

a lip top;

an upper lip portion;

a lower lip portion;

an inner peripheral portion contiguous with the lip top;

an outer peripheral portion;

an inner edge of the inner peripheral portion; and an outer edge of the outer peripheral portion, wherein the upper lip portion has a shape of a part of an ellipse, and wherein a diameter of the inner peripheral portion is greatest at the lip top and is smallest at the inner edge of the inner peripheral portion, the diameter decreasing steadily between the lip top and the inner edge.

12. The nacelle lip of an airplane engine according to claim 11, wherein an angle θu of the outer peripheral portion at the upper lip portion is greater an angle θ of the outer peripheral portion at the lower lip portion.

13. The nacelle lip of an airplane engine according to claim 11, wherein the lip top and the inner edge of the inner peripheral portion are circular in shape and parallel to each other.

14. The nacelle lip of an airplane engine according to claim 11, wherein the lower lip portion has a shape of a part of an circle.

15. The nacelle lip of an airplane engine according to claim 11, wherein the upper lip portion has a thicknesses that is not reduced as compared to thicknesses of other portions of the nacelle lip.

* * * * *